US008458893B2

(12) United States Patent
Brinlee et al.

(10) Patent No.: US 8,458,893 B2
(45) Date of Patent: Jun. 11, 2013

(54) METHOD FOR ASSEMBLING A MAGNETIC COMPONENT

(75) Inventors: Antony Brinlee, Plano, TX (US); Arturo Silva, Allen, TX (US)

(73) Assignee: Flextronics AP, LLC, Broomfield, CO (US)

( * ) Notice: Subject to any disclaimer, the term of this patent is extended or adjusted under 35 U.S.C. 154(b) by 91 days.

(21) Appl. No.: 13/157,186

(22) Filed: Jun. 9, 2011

(65) Prior Publication Data

US 2011/0232080 A1 Sep. 29, 2011

Related U.S. Application Data

(62) Division of application No. 11/935,774, filed on Nov. 6, 2007, now Pat. No. 7,969,272.

(51) Int. Cl.
*H01F 7/06* (2006.01)

(52) U.S. Cl.
USPC ..... 29/605; 29/606; 29/607; 336/200; 336/209; 336/221; 336/222; 427/104

(58) Field of Classification Search
USPC ..... 29/25.42, 592.1, 605–607; 156/185, 156/247; 336/200, 209, 221, 222, 198, 233, 336/98, 165, 145, 178, 182, 192; 427/104
See application file for complete search history.

(56) References Cited

U.S. PATENT DOCUMENTS

| | | | | |
|---|---|---|---|---|
| 3,253,241 | A * | 5/1966 | Tippett | 336/15 |
| 3,939,450 | A * | 2/1976 | Donnelly | 336/90 |
| 4,363,014 | A * | 12/1982 | Leach et al. | 336/90 |
| 4,730,178 | A * | 3/1988 | Gunnels et al. | 336/192 |
| 5,140,291 | A * | 8/1992 | Mulder et al. | 336/198 |
| 6,404,316 | B1 * | 6/2002 | Busletta et al. | 336/198 |
| 6,927,667 | B1 * | 8/2005 | Busletta et al. | 336/208 |
| 7,061,358 | B1 * | 6/2006 | Yang | 336/198 |
| 7,271,694 | B2 * | 9/2007 | Chang | 336/208 |
| 7,948,348 | B2 * | 5/2011 | Silva | 336/212 |
| 2002/0163413 | A1 * | 11/2002 | Holdahl et al. | 336/192 |

* cited by examiner

*Primary Examiner* — Paul D Kim
(74) *Attorney, Agent, or Firm* — Marsh Fischmann & Breyfogle, LLP; Per H. Larson; Danielle K. Morrow

(57) ABSTRACT

Generally, methods and processes for assembling magnetic components are presented herein. More specifically, conductors are wound around a substantially hollow bobbin. Portions of the conductors may be temporarily positioned outside the bobbin through slots in the flanges of the bobbin during the assembly process. Insulating layers may be wrapped around the conductors. The center legs of a pair of magnetic core halves may be inserted into the bobbin. The base of the magnetic core halves may have a passage to allow a conductor to pass therethrough at a height less than the height of the base.

15 Claims, 11 Drawing Sheets

METHOD FOR ASSEMBLING A MAGNETIC COMPONENT

CROSS-REFERENCE TO RELATED APPLICATION

This application is a divisional of U.S. patent application Ser. No. 11/935,774 filed Nov. 6, 2007, now U.S. Pat. No. 7,969,272, entitled "PLANAR CORE STRUCTURE," the entire contents of which are incorporated herein by reference.

BACKGROUND

Generally, magnetic components use magnetic materials for shaping and directing magnetic fields in a manner designed to achieve a desired electrical performance. Magnetic components are readily used in a wide variety of electronic equipment such as computers, televisions, telephones, etc. In operation, magnetic fields may act as the medium for storing, transferring, and releasing electromagnetic energy. Transformers are one specific example of a magnetic component, and typically comprise two or more windings of conductors (e.g., copper wire) wound around a bobbin with a magnetic core inserted through the bobbin. The bobbin may generally be made of a molded plastic or any other suitable dielectric material. The conductors may be wound around the bobbin a predetermined number of times and in a predetermined configuration to achieve specific electrical characteristics. For example, the number of windings (e.g., a primary winding and a secondary winding) and the number of turns for the conductors in each winding may be a function of the intended application for the transformer.

To form the magnetic field in the transformer, a core assembly having high magnetic permeability may be inserted into the bobbin. Often the core assembly is made in two pieces, each having an "E" shaped cross-section that may be inserted into opposite ends of the bobbin. The transformer assembly may then be held together by various physical means such as a spring clip, tape, or an adhesive.

Transformers generally operate on the principle that a change in current flowing through a first winding conductor, which is isolated from a second winding conductor, creates a magnetic flux that causes a change in the current flow in the second winding conductor. The ratio of current in the two winding conductors may generally be related to the relative number of windings of each conductor. This may in turn create a voltage that may be the product of the number of turns multiplied by the change in magnetic flux.

As electronic manufacturers are constantly striving to develop components that are smaller and less expensive, there is a need for magnetic components that meet these requirements. Constricting the size of magnetic components presents unique design challenges, as the devices must still accommodate special features that are required by the manufacturability and electrical performance characteristics of a particular application. In space-constrained applications that require magnetic components to be small in height and capable of being mounted on a printed circuit board (PCB), planar type magnetic devices (e.g., planar transformers) may be used. Planar transformers are typically made using copper lead frames and flat copper spirals instead of copper wire wound around ferrite cores as described above. The spirals may be etched on thin sheets of dielectric material and stacked on flat ferrite cores to form the magnetic circuit. Although planar transformers are useful in that they can be relatively small in size, they have a number of drawbacks (e.g., cost, efficiency, current carrying ability, etc.) that make it desirable to have alternative designs available. It is against this background that the planar core structure described herein has been developed.

SUMMARY

The following embodiments and aspects of thereof are described and illustrated in conjunction with systems, tools, and methods which are meant to be exemplary and illustrative, and not limiting in scope. In various embodiments, one or more of the above-described problems have been reduced or eliminated, while other embodiments are directed to other improvements.

According to a first aspect, a magnetic component is provided that includes a pair of core halves, each of the core halves having a base and a pair of outer legs that extend therefrom. Each of the core halves also has a center leg that extends from the base in the same direction as the pair of outer legs, the center leg being positioned substantially in the center of the base. The center leg also has a cross-section which has a primary axis that is parallel to a mounting plane, and a secondary axis which is perpendicular to the primary axis. Furthermore, the primary axis has a larger dimension than the secondary axis. The magnetic component also includes a substantially hollow bobbin that receives each center leg of the core halves. Additionally, the magnetic component includes a conductor that is wound around the bobbin.

According to a second aspect, a core half for use in a magnetic component is provided. The core half includes a base and a pair of outer legs that extend therefrom. The core half also includes a center leg that extends from the base in the same direction as the pair of outer legs, the center leg being positioned substantially in the center of the base. The center leg also has a cross-section which has a primary axis that is parallel to a mounting plane, and a secondary axis which is perpendicular to the primary axis. Furthermore, the primary axis has a larger dimension than the secondary axis.

According to a third aspect, a magnetic component is provided that includes a pair of core halves, each of the core halves having a base and a pair of outer legs that extend therefrom. Each of the core halves also has a center leg that extends from the base in the same direction as the pair of outer legs, the center leg being positioned substantially in the center of the base. The center leg also has a cross-section which has a primary axis that is parallel to a mounting plane, and a secondary axis which is perpendicular to the primary axis. Furthermore, the primary axis has a larger dimension than the secondary axis. The magnetic component also includes a substantially hollow bobbin that receives each center leg of the core halves. Additionally, the magnetic component includes a conductor that is wound around the bobbin. The center leg of each of the core halves is inserted into the bobbin, such that the first side of one of the core halves faces the mounting plane, and the first side of the other core half faces away from the mounting plane.

According to a fourth aspect, a method for assembling a magnetic component is provided which includes providing a pair of core halves, each of the core halves including a base and a pair of outer legs extending therefrom, a center leg extending from the base in the same direction as the pair of outer legs, the center leg being positioned substantially in the center of the base, wherein the center leg has a cross-section, the cross-section having a primary axis that is parallel to a mounting plane, and a secondary axis that is perpendicular to the primary axis, wherein the primary axis has a larger dimension than the secondary axis. The method further includes providing a substantially hollow bobbin that receives each center leg of the core halves, the bobbin including a flange, the flange including a slot for passing a conductor therethrough, and a winding surface. The method also includes winding a first conductor around the winding surface of the bobbin and temporarily positioning a portion of the first conductor outside of the bobbin through the slot of the flange; wrapping an insulating layer around the bobbin such that the insulating layer substantially covers the first conductor; winding a second conductor around the bobbin over the insulating layer; passing the portion of the first conductor across an area over the winding surface and over the second conductor; and inserting the center legs of each of the core halves into the bobbin.

Various refinements exist of the features noted in relation to the various aspects. Additionally, further features may be incorporated in the various aspects. These refinements and additional features may exist individually or in any combination, and various features of the various aspects may be combined. For example, each of the core halves may include a passage that extends between the front and back of the base of the core halves. Additionally, the passage may be sized such that a conductor may pass therethrough at a height that is less than or equal to the height of the base. Furthermore, the assembled core halves may form a structure that has a length, width, and height that defines a cuboid, wherein the bobbin and conductor are substantially positioned within the cuboid.

In addition to the exemplary aspects and embodiments described above, further aspects and embodiments will become apparent by reference to the drawings and by study of the following descriptions.

DETAILED DESCRIPTION

Figure 1:
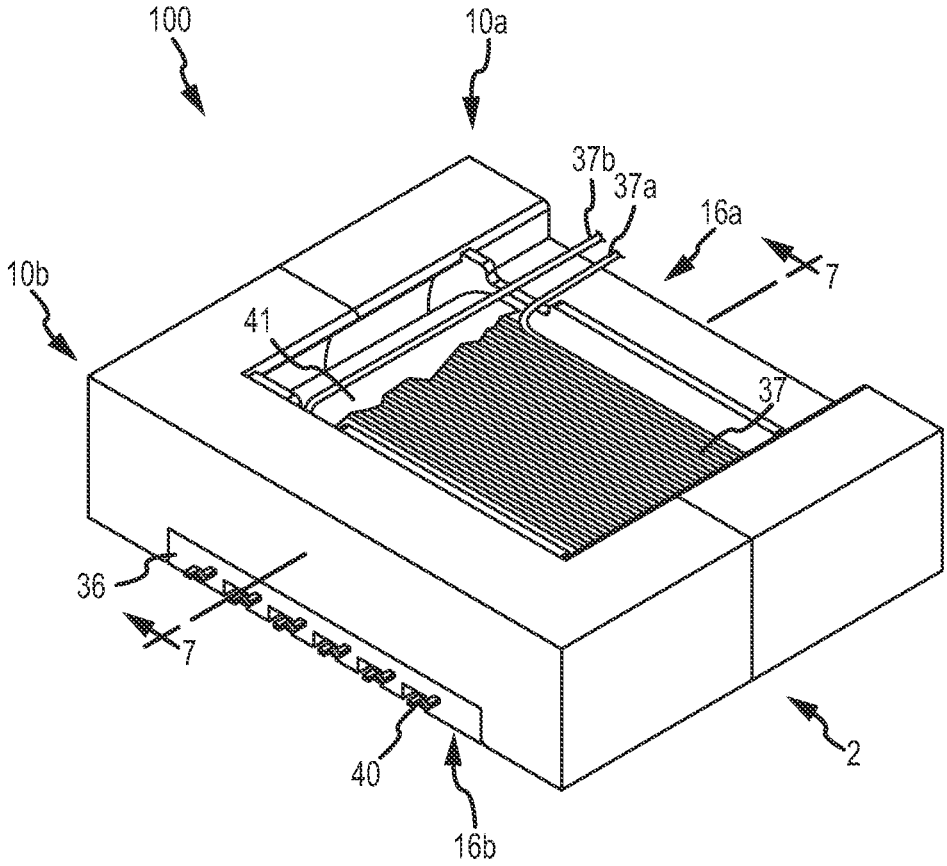
FIG. 1 is a perspective view of an exemplary embodiment of a low-profile transformer.

While the invention is susceptible to various modifications and alternative forms, specific embodiments thereof have been shown by way of example in the drawings and are herein described in detail. It should be understood, however, that it is not intended to limit the invention to the particular form disclosed, but rather, the invention is to cover all modifications, equivalents, and alternatives falling within the scope and spirit of the invention as defined by the claims.

Referring now to FIG. 1, an exemplary embodiment of a low-profile transformer 100 is illustrated. The transformer 100 may include a core assembly 2 that includes pair of core halves 10*a*, 10*b* that are abutted together around a hollow bobbin (e.g., a bobbin 20 shown in FIG. 4). The core halves 10*a*, 10*b* may also have center legs (e.g., the center legs 14*a*, 14*b* shown in FIG. 4) that are inserted into the bobbin to form a magnetic circuit. Furthermore, the bobbin may have one or more conductors (e.g., the conductor 37) wrapped around it. Additionally, the bobbin may include a terminal plate 36 for terminating the conductors on the terminal pins 40. Furthermore, the terminal pins 40 may be used to couple the conductors to a PCB. The core halves 10*a*, 10*b* may include a recess 16*a*, 16*b* to enable the ends of the conductors (e.g., the conductor ends 37*a*, 37*b*) to enter and exit the core assembly 2. The specific features of each component of the transformer 100 are discussed in detail below.

Figure 2:
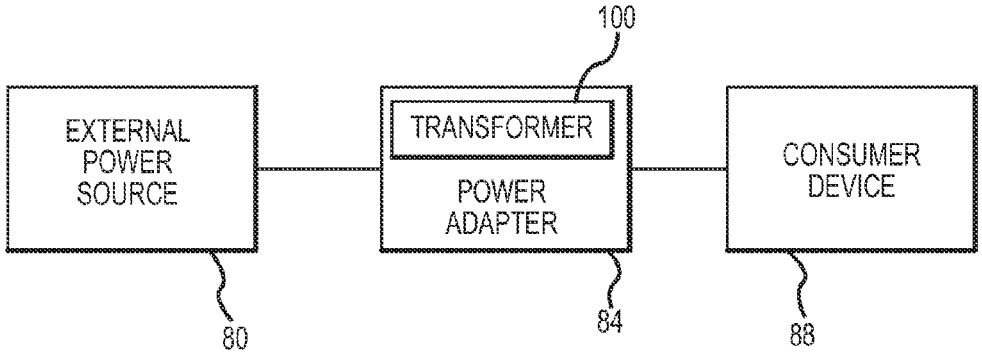
FIG. 2 is a block diagram that illustrates an exemplary application for a low-profile transformer.

FIG. 2 illustrates an exemplary application for the low-profile transformer 100 of FIG. 1. As shown, the transformer 100 may be included as a component in a power adapter 84 for a consumer device 88. The consumer device 88 may be a portable computing device (e.g., a notebook computer, a personal digital assistant, a tablet PC, or the like), or a mobile telephone, portable music player, or the like. The power adapter 84 may function to modify the output from an external power source 80 to a level that is suitable for the consumer device 88. In this application, it may be desirable that the power adapter 84 be as small as possible, so that a user may easily carry and store it. Often, the transformer may be the component that limits the minimum height of the power adapter. Therefore, there is an aspiration to make the transformer as low-profile as possible. As discussed below, the low-profile transformer 100 of the present invention meets this requirement. Those skilled in the art will readily recognize that the low-profile transformer 100 may also be used in various other applications.

Figure 3:
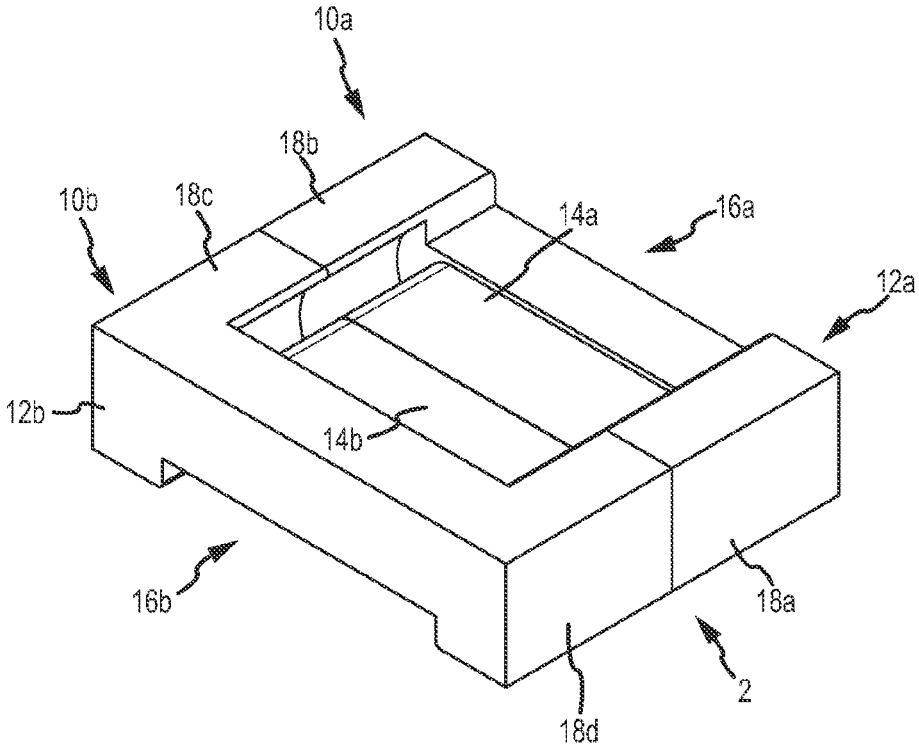
FIG. 3 is a perspective view of an exemplary embodiment of a pair of core halves abutted together.

FIG. 3 illustrates a perspective view of the core assembly 2. The core assembly 2 may include the core halves 10*a*, 10*b* that include a base 12*a*, 12*b*, the center legs 14*a*, 14*b*, and outer legs 18*a*, 18*b*, 18*c*, 18*d*. When assembled, the core halves 10*a*, 10*b* may be abutted together such that their respective center legs 14*a*, 14*b* are in contact with each other; however, there may be a small air gap between the center legs 14*a*, 14*b* when the core is assembled in order to linearize the inductance of the transformer. In some applications that require a significant amount of energy storage in the transformer, such as flyback transformers, the air gap might comprise a noticeable percentage of the entire length of the center legs 14*a*, 14*b*. It should be noted that the air gap does not have to be uniform across the cross-section of the center legs 14*a*, 14*b*. Furthermore, it should be noted that an air gap may also be placed between the outer legs 18*a*, 18*b*, 18*c*, 18*d* of the core halves 10*a*, 10*b*. In other applications, however, it should be appreciated that the outer legs 18*a*, 18*d*, and 18*b*, 18*c* may be in contact with each other. As shown, the two core halves 10*a*, 10*b* are constructed for positioning in an opposed relationship to each other when assembled. In this embodiment, the core half 10*b* may be rotated 180 degrees relative to the core half 10*a* about an axis that passes through the center of each of the center legs 14*a*, 14*b* and extends in the same direction. In this configuration, a recess 16*b* of the core half 10*b* is positioned toward the bottom of the transformer 100. This permits conductors to enter and exit the transformer 100 through the bottom, which may permit the conductors to be terminated on a mounting plane formed by a PCB such that the terminations do not increase the overall height of the transformer 100. Similarly, a recess 16*a* may be positioned toward the top of the core half 10*a* to permit conductors to enter and exit the top portion of the core half 10*a* such that the terminations do not increase the overall height of the transformer 100, which may be desirable in particular applications.

Figure 4:
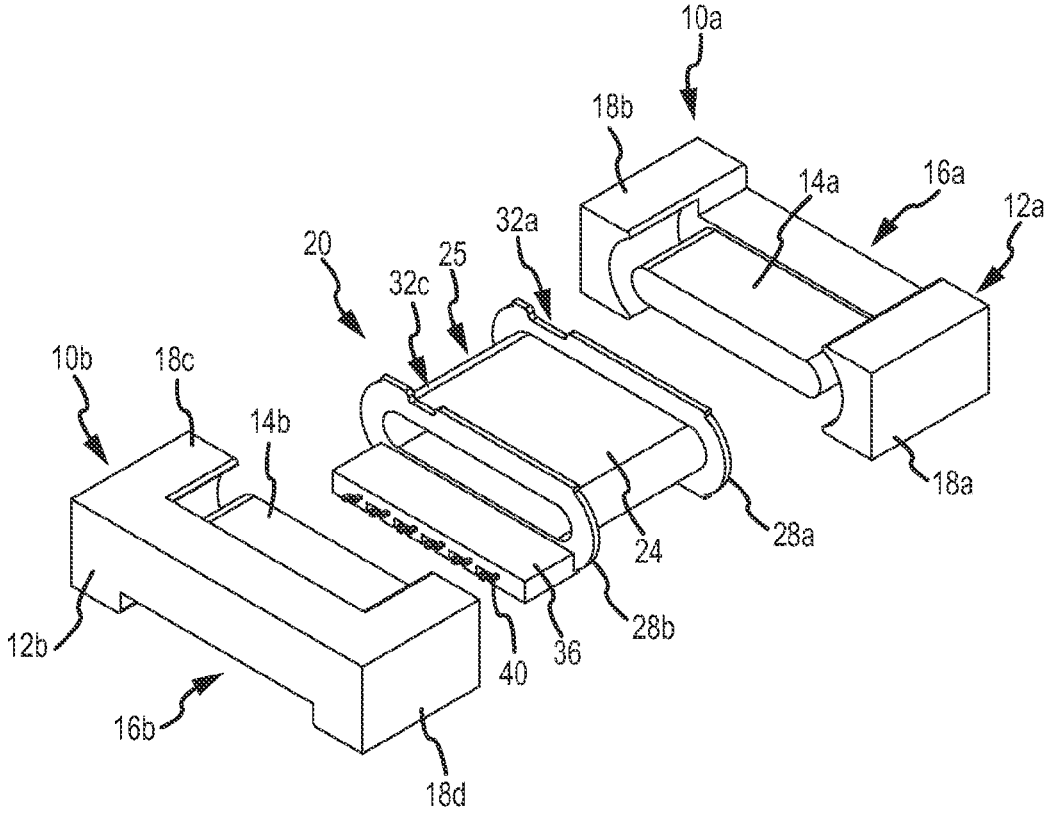
FIG. 4 is a disassembled perspective view of an exemplary low-profile transformer, omitting the conductors.
Figure 7:
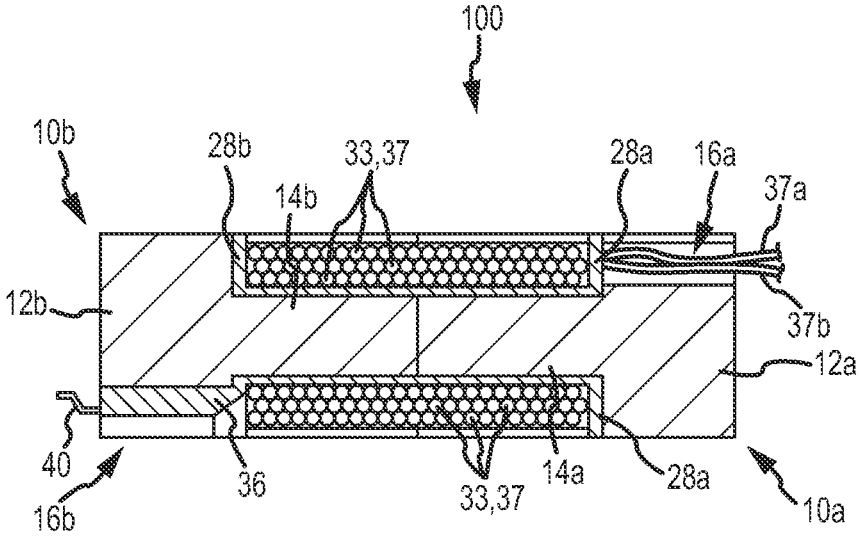
FIG. 7 is a cross-sectional view of the transformer of FIG. 1 along the line 7-7 of FIG. 1.

FIG. 4 is a disassembled perspective view of the low-profile transformer 100 with the conductors omitted. The transformer 100 includes the bobbin 20, and the pair of core halves 10*a*, 10*b* which each form an E-shaped structure. The bobbin 20 may be manufactured of any suitable dielectric material, such as a plastic material. The bobbin 20 may include a winding surface 24 for winding one or more conductors (e.g., the conductor 37 of FIG. 1) thereon. In this embodiment, the bobbin 20 may include opposing flanges 28*a*, 28*b* that, together with the winding surface 24, define a winding area 25. The flanges 28*a*, 28*b* may include one or more notches (e.g., notches 32*a*, 32*b*, 32*c*) for permitting the entry and exit of conductors to the winding area 25 of the bobbin 20. It should be appreciated that the notches 32*a*, 32*b*, 32*c* permit one or more conductors to enter and exit the winding area 25 at a height which is less than the height of the flanges 28*a*, 28*b*, and correspondingly, less than the height of the core halves 10*a*, 10*b*. Accordingly, the assembled core halves 10*a*, 10*b* may have a length, width, and height that form a cuboid, and the conductors and bobbin may be substantially contained within the cuboid. This feature is also illustrated in FIG. 7, which is a cross-sectional view of the transformer 100 along the line 7-7 of FIG. 1. As can be seen, the conductors (e.g., the conductors 33 and 37 of FIG. 8A) are contained within the height of the core halves 10*a*, 10*b*. Similarly, the conductors may enter and exit the core halves 10*a*, 10*b*, at a height that is less than the height of the core halves 10*a*, 10*b* through the recesses 16*a*, 16*b*. This feature may be advantageous in space-constrained applications. The bobbin 20 may further include a terminal plate 36 coupled to the flange 28*b* for providing termination of the conductors. The terminal pins 40 may extend from the terminal plate 36 so that the conductors may be coupled to a PCB.

To assemble the transformer 100, the center legs 14*a*, 14*b* of the core halves 10*a*, 10*b* may be inserted into corresponding sides of a hollow portion in the bobbin 20. The center legs 14*a*, 14*b* may then be in contact or nearly in contact with each other inside the bobbin 20. As discussed above, the outer legs 18*a*, 18*d* of the core halves 10*a*, 10*b* may also be in contact, as are the outer legs 18*b*, 18*d*, to form a magnetic circuit.

Figure 5A:
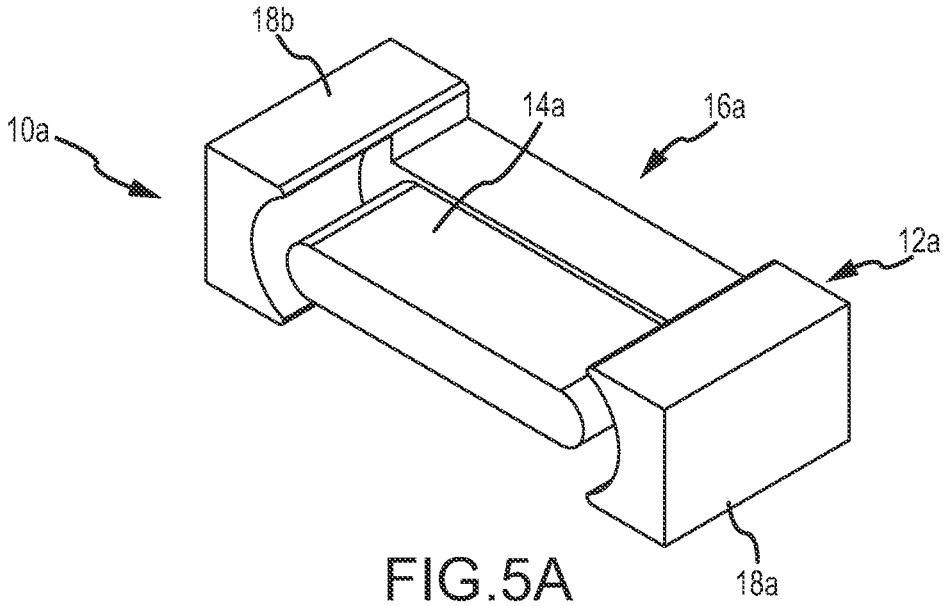
FIG. 5A is a perspective view of an exemplary core half.
Figure 5B:
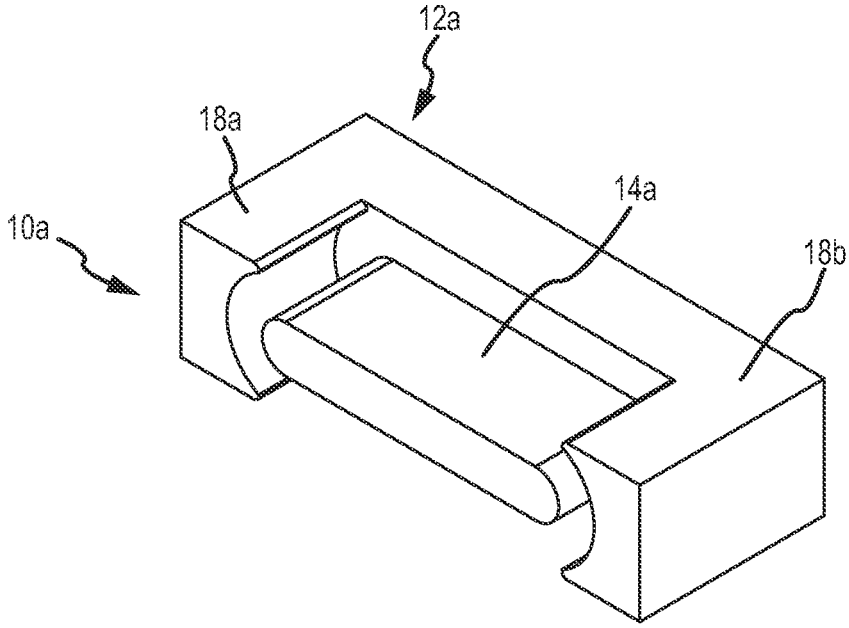
FIG. 5B is a perspective view of the bottom of the core half of FIG. 5A.
Figure 5C:
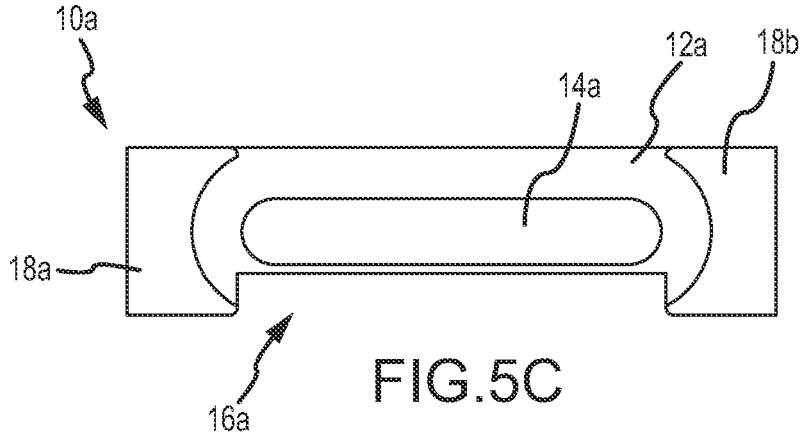
FIG. 5C is a front elevation view of the core half of FIG. 5A.

FIGS. 5A-5C illustrate various views of the core half 10*a*. In one embodiment, the base 12*a*, center leg 14*a*, and outer legs 18*a*, 18*b* may be integrally formed as a single piece of material (e.g., ferrite material, ferrous powder, or the like). Additionally, the center leg 14*a* may extend substantially perpendicularly from the front of the base 12*a* and may be substantially centrally located on the front of the base 12*a*. Furthermore, the cross-section of the center leg 14*a* may have a vertical axis that is perpendicular to a mounting plane (e.g. a PCB), and a horizontal axis that is parallel to a mounting plane. In this embodiment, the center leg 14*a* has a horizontal axis that is greater than the vertical axis. For example, the ratio of the horizontal axis to the vertical axis may be greater than 1.5:1, greater than 4:1, greater than 6:1, or the like. This feature may be useful in applications where the height of the transformer is restricted, such as the power adapter application described above in reference to FIG. 2. Additionally, the present embodiment may exhibit reduced leakage inductance due to the relatively long winding area that results from an elongated horizontal axis. Having a relatively large surface area may also provide better cooling for the transformer 100 as well.

Figure 5D:
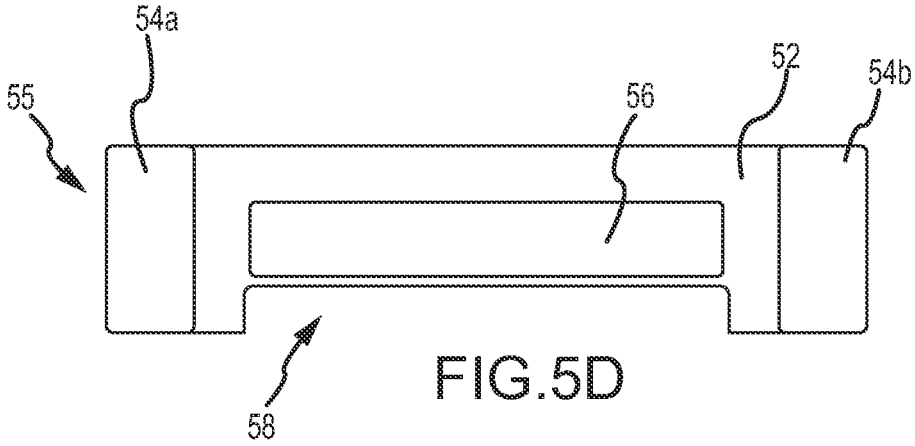
FIG. 5D is a front elevation view of an alternative embodiment of a core half.
Figure 6A:
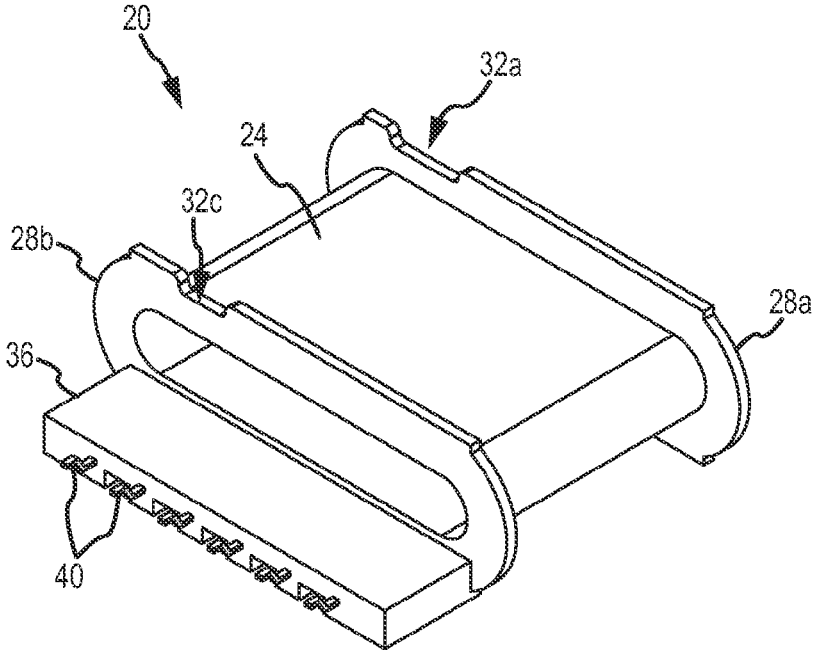
FIG. 6A is a perspective view of an exemplary bobbin.
Figure 6B:
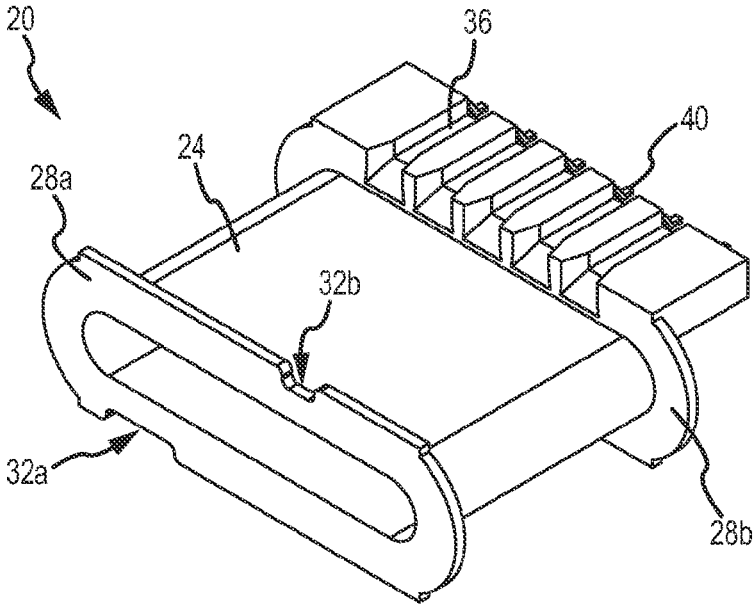
FIG. 6B is another perspective view of an opposite side of the bobbin of FIG. 6A.
Figure 6C:
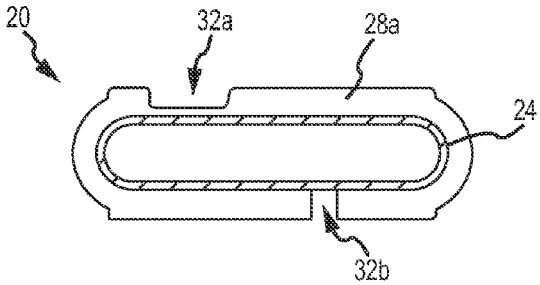
FIG. 6C is a front elevation view of the bobbin of FIG. 6A.
Figure 6D:
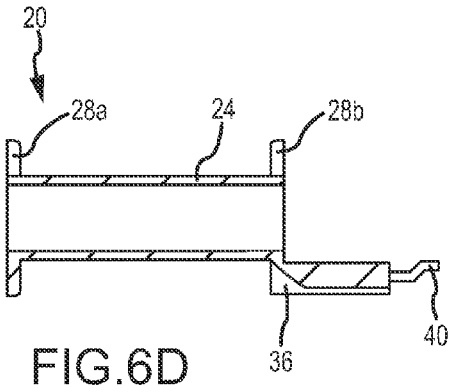
FIG. 6D is a side elevation view of the bobbin of FIG. 6A.
Figure 6E:
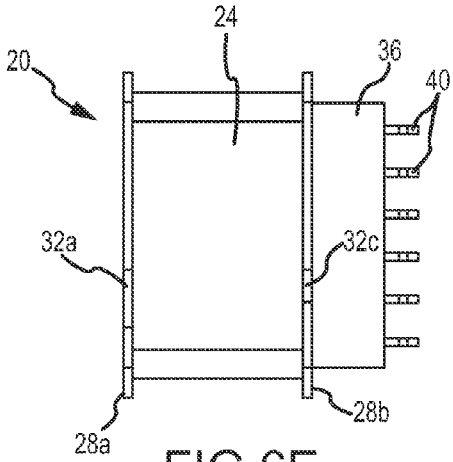
FIG. 6E is a top view of the bobbin of FIG. 6A.

Additionally, it is notable that the cross-section of the center leg 14*a* is not limited to any specific shape. For example, in one embodiment the cross-section may be substantially the shape of a rectangle combined with two opposing semicircles. The rectangle may have long and short sides, and the semicircles may be equal in diameter to the length of the short sides and positioned adjacent to the two short sides of the rectangle. Alternatively, the cross-section of the center leg 14*a* may be substantially rectangularly shaped. For example, FIG. 5D shows an embodiment of a core half 55 that includes a base 52, outer legs 54*a*, 54*b*, a center leg 56, and a recess 58. A shown, the cross-section of the center leg 56 is substantially rectangularly shaped. Those skilled in the art will recognize that other shapes and dimensions may also be used.

FIGS. 6A-6E illustrate various views of the bobbin 20. As discussed above, the bobbin 20 may include a winding surface 24, and a hollow section that is shaped to receive the center legs (e.g., the center legs 14*a*, 14*b* of FIG. 3) of a pair of core halves (e.g., the core halves 10*a*, 10*b*). The winding surface 24 may be used to wind conductors around to form coils. Positioned on each side of the winding surface 24 may be two opposing flanges 28*a*, 28*b*. The flanges 28*a*, 28*b* may function to constrain the position of conductors on the winding surface 24. Additionally, the flanges 28*a*, 28*b* of the bobbin 20 may also include notches 32*a*, 32*b*, 32*c* for permitting the ends of conductors to pass to and from the winding surface 24. Furthermore, the notches 32*a*, 32*b*, 32*c* may be used during the assembly process of a transformer, as is discussed below in reference to FIGS. 8A-8B.

Figure 8A:
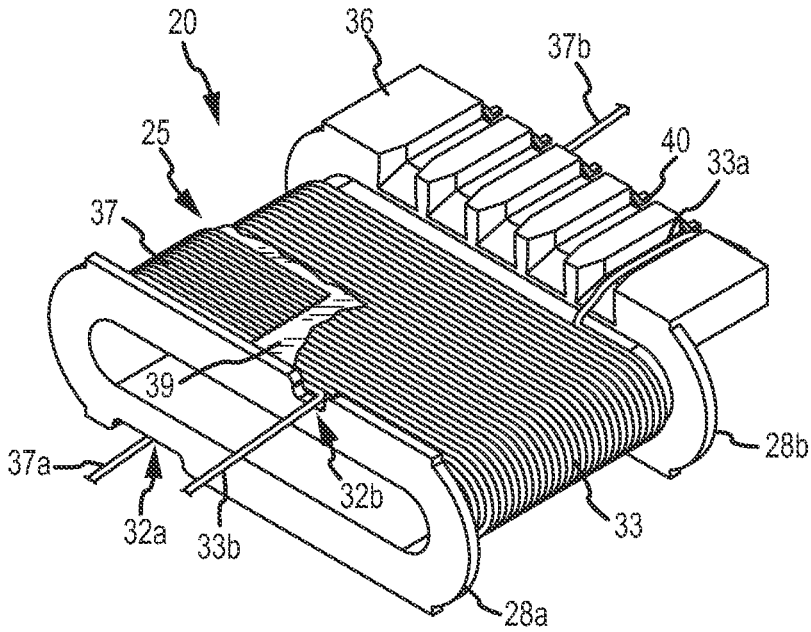
FIGS. 8A-8B are perspective views of the bobbin of FIG. 6A illustrating a winding structure for an exemplary low-profile transformer.
Figure 8B:
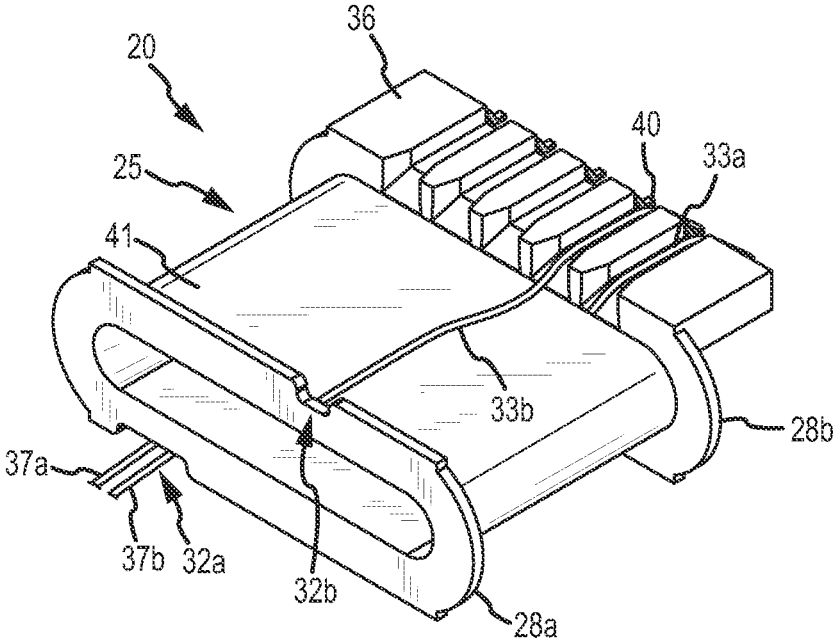

Turning now to FIGS. 8A-8B, a winding structure for an exemplary transformer such as the transformer 100 is illustrated. As shown in FIG. 8A, a first end 33*a* of an inner conductor 33 may be terminated at one of the terminal pins 40 of the terminal plate 36. The inner conductor 33 may then be wound around the winding surface 24 of the bobbin 20 from a point near the flange 28*b* toward the flange 28*a*. A second end 33*b* of the inner conductor 33 may be temporarily pulled out of the winding area 25 of the bobbin 20 through the notch 32*b* on the flange 28*a*. Next, an insulation layer 39 may be placed over the inner conductor 33 to provide isolation from other conductors. The insulation layer 39 may be any dielectric material suitable for isolating conductors. Additionally, a first end 37*a* of an outer conductor 37 may enter the bobbin 20 through the notch 32*a* on the flange 28*a*. Similar to the winding method described above, the outer conductor 37 may be wound across the winding area 25 from the side near the flange 28*a* toward the flange 28*b*, where a second end 37*b* of the outer conductor 37 may be temporarily pulled out of the winding area 25 of the bobbin 20 through the notch 32*c* (shown in FIG. 6A) on the flange 28*b*. Then, as shown in FIG. 8B, another insulation layer 41 may be placed over the outer conductor 37. It should be noted that the presence or absence of various insulation layers (e.g., the insulation layers 39 and 41) may vary depending on the particular application. Subsequently, the second end 33*b* of the inner conductor 33 may then be placed across the winding area 25 and over the insulation layer 41 where it may be terminated at one of the terminal pins 40. Similarly, the second end 37*b* of the outer conductor 37 may be pulled out of the notch 32*c* and across the winding area 25 in the opposite direction where it may exit the bobbin 20 through the notch 32*a* on the flange 28*a*. The ends 33*a*, 33*b*, 37*a*, 37*b* of the conductors 33, 37 may then be coupled to a source or load depending on the specific application. Using this method of winding the conductors, the leakage inductance may be reduced, thereby improving the performance of the transformer 100.

It should be appreciated that the planar core structure described herein has several benefits and advantages over previous designs. The relatively flat core geometry, together with the recesses that allow the conductors to exit the core without increasing the height, permit the planar core structure to be used in applications that require a low-profile design. Furthermore, the geometry of the planar core structure causes the resulting transformer to have a relatively large winding area, which may allow for better cooling. The larger winding area may also reduce the number of layers of conductors required, which may reduce proximity effects and leakage losses, thereby improving the performance of the transformer. Additionally, it should be appreciated that the planar core structure described herein may be useful in other magnetic components, such as inductors. Those skilled in the art will readily recognize that there are various other applications where the planar core structure may be suitable.

While the invention has been illustrated and described in detail in the drawings and foregoing description, such illustration and description is to be considered as exemplary and not restrictive in character. For example, certain embodiments described hereinabove may be combinable with other described embodiments and/or arranged in other ways. Accordingly, it should be understood that only the preferred embodiment and variants thereof have been shown and described and that all changes and modifications that come within the spirit of the invention are desired to be protected.

What is claimed is:

1. A method for assembling a magnetic component, comprising:

winding a first conductor around a winding surface of a substantially hollow bobbin, the bobbin including a first flange, the first flange including a slot for passing a conductor therethrough, wherein a portion of the first conductor is temporarily positioned outside of the bobbin through the slot of the first flange;

winding a second conductor around the bobbin over the first conductor; and passing the portion of the first conductor across the winding surface and over the second conductor.

2. The method of claim 1, further comprising the step of wrapping a first insulating layer around the bobbin before winding the second conductor such that the first insulating layer substantially covers the first conductor.

3. The method of claim 2, further comprising the step of wrapping a second insulating layer around the bobbin such that the second insulating layer substantially covers the second conductor.

4. The method of claim 1, wherein during the step of winding the second conductor around the bobbin a portion of the second conductor is temporarily positioned outside the bobbin through a slot of a second flange of the bobbin.

5. The method of claim 4, further comprising the step of passing the portion of the second conductor across the winding surface and over the second conductor.

6. The method of claim 5, further comprising the steps of:

wrapping a first insulating layer around the bobbin before winding the second conductor such that the first insulating layer substantially covers the first conductor; and wrapping a second insulating layer around the bobbin such that the second insulating layer substantially covers the second conductor, wherein the portion of the first conductor and the portion of the second conductor are passed over the winding surface of the bobbin over the second insulating layer.

7. The method of claim 5, wherein the portion of the second conductor is passed across the winding surface in an opposite direction as the portion of the first conductor.

8. The method of claim 7, wherein the cross-section of the center leg has arcuately shaped edges.

9. The method of claim 1, further comprising the step of inserting the center legs of each of a pair of core halves into the bobbin, each of the core halves including a base and a pair of outer legs extending therefrom, a center leg extending from the base in the same direction as the pair of outer legs, the center leg being positioned substantially in the center of the base, wherein the center leg has a cross-section, the cross-section having a primary axis that is parallel to a mounting plane, and a secondary axis that is perpendicular to the primary axis, wherein the primary axis has a larger dimension than the secondary axis.

10. The method of claim 9, wherein the base of each of the core halves has a front, a back, a top, and a bottom, and wherein the base includes a passage that extends between the front and the back.

11. The method of claim 10, wherein the base has a height, and wherein the passage is sized such that the conductor may pass therethrough at a height that is less than the height of the base.

12. The method of claim 9, wherein the cross-section of the center leg is substantially rectangularly shaped.

13. The method of claim 9, wherein the base, outer legs, and center legs of each of the core halves are a unitary structure.

14. The method of claim 1, wherein the second conductor enters the bobbin through a notch on the first flange of the bobbin.

15. The method of claim 14, wherein the portion of the second conductor exits the bobbin through the notch on the first flange of the bobbin.

* * * * *